United States Patent [19]

Menon et al.

[11] 4,045,163

[45] Aug. 30, 1977

[54] HEATED FUSER RELEASE AGENT CONTAINER

[75] Inventors: Sukumaran K. Menon, Webster; Louis R. Hattler, Marion, both of N.Y.

[73] Assignee: Xerox Corporation, Stamford, Conn.

[21] Appl. No.: 719,043

[22] Filed: Aug. 30, 1976

[51] Int. Cl.[2] ..... F27B 9/28

[52] U.S. Cl. ..... 432/59; 118/60; 118/70

[58] Field of Search ..... 118/60, 70, 203, 104, 118/202, 259, 258; 432/75, 60, 59

[56] References Cited

U.S. PATENT DOCUMENTS

| | | | |
|---|---|---|---|
| 535,393 | 3/1895 | Norton | 118/60 |
| 2,659,340 | 11/1953 | Zinn | 118/202 |
| 2,724,362 | 11/1955 | Burke et al. | 118/202 X |
| 3,347,205 | 10/1967 | Dobbyn | 118/202 X |
| 3,548,781 | 12/1970 | Hornung | 118/202 |
| 3,608,521 | 9/1971 | Gopel | 118/202 |
| 3,762,365 | 10/1973 | Herzog | 118/259 |
| 3,818,860 | 6/1974 | Rebentisch | 118/203 |
| 3,828,724 | 8/1974 | Kordi | 118/258 |
| 3,929,094 | 12/1975 | Thettu | 118/60 |
| 3,929,096 | 12/1975 | Thettu | 118/60 |

*Primary Examiner*—Ronald Feldbaum

*Attorney, Agent, or Firm*—J. J. Ralabate; C. A. Green; H. Fleischer

[57] ABSTRACT

An apparatus in which a metered quantity of release material is applied to a fuser roll. The release material is heated to maintain it substantially in a fluid state.

4 Claims, 2 Drawing Figures

HEATED FUSER RELEASE AGENT CONTAINER

The foregoing abstract is neither intended to define the invention disclosed in the specification, nor is it intended to be limiting as to the scope of the invention in any way.

BACKGROUND OF THE INVENTION

This invention relates generally to an electrostatographic printing machine, and more particularly concerns an apparatus for metering a quantity of fluid release material to a heated fuser member.

In a typical electrostatographic printing machine, a latent image is recorded on a surface and developed with charged particles. These charged particles are transferred to a sheet of support material. Thereafter, the particles are permanently affixed to the sheet of support material forming a copy of the original document. Electrostatographic printing includes both electrophotographic printing and electrographic printing. Electrophotographic printing utilizes a photoconductive member which is sensitized by charging thereof to a substantially uniform level. A light image of the original document is projected onto the charged portion of the photoconductive surface. The light image dissipates the charge in the irradiated areas recording thereon an electrostatic latent image. Electrographic printing differs from electrophotographic printing in that a photoconductive member or a light image is not required to create a latent image of the original document. Generally, both of the foregoing processes employ heat settable particles which are permanently affixed to the sheet of support material by the application of heat thereto.

The particles are permanently affixed to the sheet of support material by heating them to a point at which the constituents thereof coalesce and become tacky. This action causes some absorption of the particles into the fibers of the sheet of support material which may be amongst others, plain paper. As the particles cool and solidify, they form a firm bond on the sheet of support material. The use of heat to permanently affix powder images to a sheet of support material is well known in the art.

One approach for applying heat to the particles is by passing the sheet of support material with the powder image thereon through a pair of opposed rollers, at least one of which being heated. A system employing such a pair of rollers may utilize a heated roller having the outer surface thereof covered with polytetrafluoroethylene, commonly known as Teflon, to which a release agent, such as silicon oil is applied. Preferably, the Teflon layer is relatively thin and has a thickness of less than one micron. This arrangement prevents the particles from transferring from the sheet of support material to the heated roller and insures that they remain on the sheet of support material as heat is applied.

Alternatively, a metal roller may be heated and a low molecular polyethylene applied thereto as a release agent. However, polyethylene is generally a solid at room temperature. Hence, it must be maintained in a liquid state in order to be useful as a release agent. To prevent the premature failure of the release agent, it is required to keep all the release agent in a liquid state. If the polyethylene is not maintained in the liquid state, it will form oxides and the concentration thereof will prevent it from functioning as a release agent. The time required for the polyethylene release agent to fail is proportional to the quantity of release agent in this storage housing. Thus, if a release agent is only partially molten, a reduced quantity of release agent is maintained in the storage container and the oxide concentration will occur more rapidly.

Accordingly, it is a primary object of the present invention to improve a fusing apparatus by maintaining substantially all of the release agent in a liquid condition.

SUMMARY OF THE INVENTION

Briefly stated, and in accordance with the present invention, there is provided an apparatus for metering a quantity of release material to a fuser member. The fuser member is operatively associated with a back-up member. A sheet of support material having particles thereon passes between the fuser member and back-up member.

Pursuant to the features of the present invention, the apparatus includes means for storing a supply of release material therein. Heating means associated with the storing means maintain the release material in a substantially fluid state. Means are provided for applying release material from the storing means to the surface of the fuser member.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
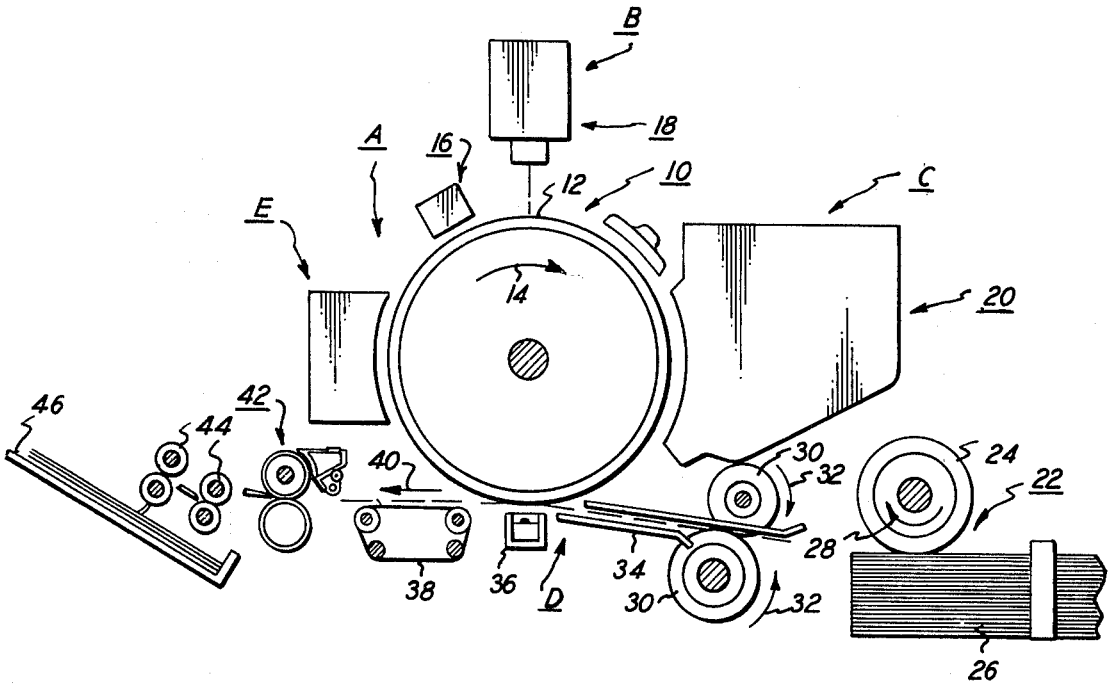
FIG. 1 is a schematic elevational view illustrating an electrophotographic printing machine incorporating the features of the present invention therein.

For a general understanding of an electrophotographic printing machine in which the present invention may be incorporated, reference is had to FIG. 1 which depicts schematically the various components thereof. Hereinafter, like reference numerals will be employed throughout to designate identical elements. Although the apparatus for metering the release agent to a fusing member employed in an electrophotographic printing machine is particularly well adapted for use therein, it should become evident from the following discussion that it is equally well suited for use in a wide variety of devices and is not necessarily limited in its application to the particular embodiment shown herein.

Inasmuch as the practice of electrophotographic printing is well known in the art, the various processing stations thereof are hereinafter represented schematically. These stations will now be described briefly.

In all electrophotographic printing machines of the type illustrated, a drum 10 having photoconductive surface 12 entrained about and secured to the exterior surface thereof is rotated, in the direction of arrow 14, through the various processing stations. One type of suitable photoconductive material is described in U.S. Pat. No. 2,970,906 issued to Bixby in 1961. Initially, drum 10 rotates a portion of photoconductive surface 12 through charging station A. Charging station A employs a corona generating device, indicated generally by the reference numeral 16, to sensitize photoconductive surface 12. Corona generating device 16 is positioned closely adjacent to photoconductive surface 12. When energized, corona generating device 16 charges photoconductive surface 12 to a relatively high substantially uniform potential. For example, a suitable corona generating device 16 may be of a type described in U.S. Pat. No. 2,836,725 issued to Vyverberg in 1958.

Thereafter, drum 10 rotates the charged portion of photoconductive surface 12 to exposure station B. Exposure station B includes a stationary, transparent platen member, such as a glass plate or the like, for supporting an original document thereon. Lamps illuminate the original document. Scanning of the original document may be achieved by oscillating a mirror in a timed relationship with the movement of drum 10. This mirror is located beneath the platen and adapted to reflect the light image of the original document through a lens onto a mirror which, in turn, transmits the light image through an apertured slit onto the charged portion of photoconductive surface 12. Irradiation of the charged portion of photoconductive surface 12 records thereon an electrostatic latent image corresponding to the original document.

Drum 10 next rotates the electrostatic latent image recorded on photoconductive surface 12 to development station C. Development station C includes a developer unit 20 having a housing with a supply of developer mix therein. The developer mix comprises carrier granules with toner particles adhering triboelectrically thereto. Carrier granules are preferably formed from a magnetic material with the toner particles being formed from a heat settable plastic. Preferably, developer unit 20 is a magnetic brush developer system. In such a system, the developer mix is brought through a directional flux field to form a brush thereof. The electrostatic latent image recorded on photoconductive surface 12 is developed by bringing the brush of developer mix into contact therewith. In this manner, the toner particles are attracted electrostatically to the latent image forming a toner powder image on photoconductive surface 12.

With continued reference to FIG. 1, a sheet of support material is advanced by sheet feeding apparatus 22 to transfer station D. Sheet feeding apparatus 22 includes a feed roll 24 contacting the uppermost surface of a stack of sheets of support material 26. Feed roll 24 rotates in the direction of arrow 28 to advance the uppermost sheet from stack 26. Registration rollers 30 rotating in the direction of arrow 32, align and forward the advancing sheet of support material into chute 34. Chute 34 directs the advancing sheet of support material into contact with drum 10 in a timed sequence so that the toner powder image developed thereon contacts the advancing sheet of support material at transfer station D.

At transfer station D, corona generating device 36 applies a spray of ions to the backside of the sheet of support material. This attracts the toner powder image from photoconductive surface 12 to the sheet of support material.

After transferring the toner powder image to the sheet of support material, the sheet of support material is advanced by conveyor 38, in the direction of arrow 40, to a fusing apparatus, indicated generally by the reference numeral 42. Fusing apparatus 42 permanently affixes the transferred toner powder image to the sheet of support material. After the fusing process, the sheet of support material is advanced by a series of rollers 44 to catch tray 46 for subsequent removal therefrom by the machine operator. Fusing apparatus 42 will be discussed in greater detail hereinafter with reference to FIG. 2.

Invariably, after the sheet of support material is separated from photoconductive surface 12, some residual toner particles remain adhering thereto. These residual toner particles are removed from photoconductive surface 12 at cleaning station E. Initially, toner particles are brought under the influence of a cleaning corona generating device adapted to neutralize the remaining electrostatic charge on photoconductive surface 12 and that of the residual toner particles. The neutralized toner particles are removed from photoconductive surface 12 by a rotatably mounted fibrous brush in contact therewith. Subsequent to cleaning, a discharge lamp floods photoconductive surface 12 with light to dissipate any residual electrostatic charge remaining thereon prior to the initiation of the next successive machine cycle.

It is believed that the foregoing description is sufficient for purposes of the present application to illustrate the general operation of an electrophotographic printing machine. Referring now to the specific subject matter of the present invention, FIG. 2 depicts fusing apparatus 42 in greater detail.

Figure 2:
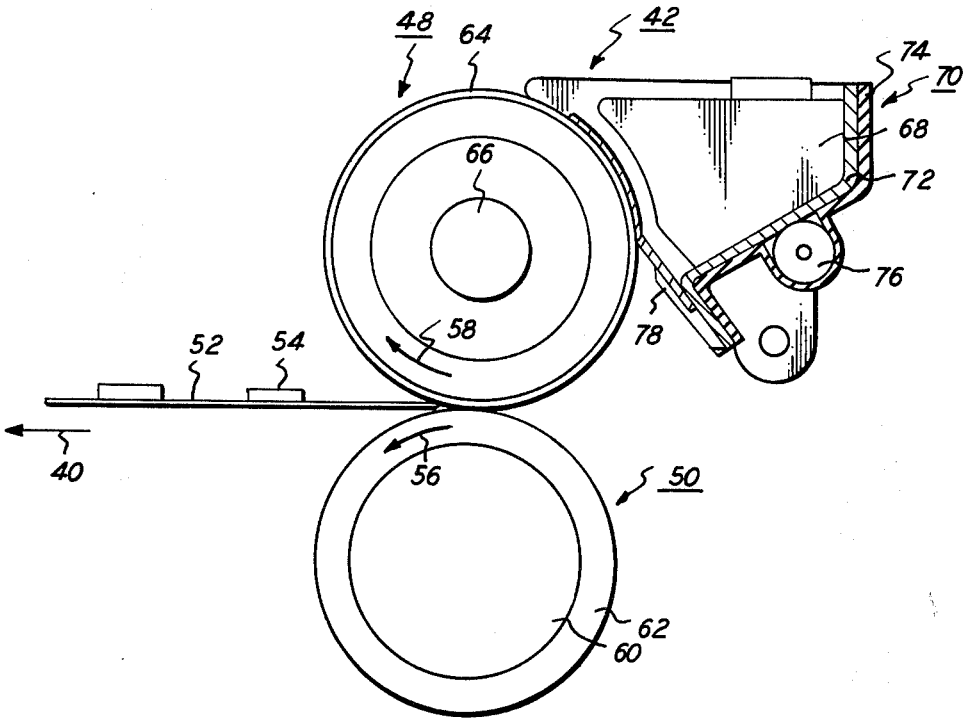
FIG. 2 is a sectional elevational view showing the FIG. 1 fuser assembly.

Referring now to FIG. 2, fusing apparatus 42 includes a heated fuser roll, indicated generally by the reference numeral 48, and a backup roller, indicated generally by the reference numeral 50. Fuser roller 48 cooperates with backup roller 50 to define a nip through which a sheet of support material 52 having the toner powder image 54 thereon passes. The sheet of support material is oriented so that the toner powder image thereon contacts fuser roll 48. A channel shaped base (not shown) is provided for supporting fusing apparatus 42 in the electrophotographic printing machine of FIG. 1. Backup roll 50 is mounted rotatably on a pair of brackets secured to the channel shaped base by means of a right angle bracket. Backup roll 50 rotates in the direction of arrow 56. Similarly, fuser roll 48 rotates in the direction of arrow 58. Preferably, backup roll 50 includes a rigid steel core or shaft 60 having a Viton elastomeric surface or layer 62 disposed thereover and affixed thereto. Shaft 60 is secured rotatably on brackets by a pair of bearings secured thereto by retaining rings. Other suitable high temperature elastomeric materials which may be utilized are fluorosilicon or silicon rubber.

A pair of brackets (not shown) having a generally E-shaped configuration are provided for mounting fuser roll 48 rotatably in fusing apparatus 42. To this end, a pair of ball bearings, one mounted at each of the supports, provide a rotatable support. The bearings are retained in the brackets by means of retaining rings. A pair of end caps are secured to a hollow cylinder or core 64 forming a part of fuser roll 48. A heating element 66 is supported internally of cylinder 64 and provides thermal energy thereto so as to maintain it at the operating temperature thereof. Heating element 64 develops sufficient heat to elevate the surface temperature of cylinder 64 to the operational temperature thereof of about 285°

F to about 295° F. By the way of example, heating element 66 may include a quartz envelope having a tungsten resistance heating element disposed therein. Preferably, cylinder 64 is fabricated from any suitable material capable of efficiently conducting heat to the external surface thereof. For example, suitable materials are aluminum and alloys thereof, steel, stainless steel, nickel and nickel alloys thereof, nickel plated copper, chromium plated copper and alloys thereof. Fuser roll 64 requires about 420 watts peak power with the average power being about 320 watts, and about 100 watts being required for standby operation. Heating element 66 is supported internally of cylinder 64 by a pair of brackets mounted in an insulating block. These blocks are secured to electrical terminals having wires attached thereto for exciting heating element 66. Cylinder 64 is fabricated from a material which generally has a relatively high surface energy. Toner material, in contact therewith, readily wets this surface. If the toner wets the surface of cylinder 64, it is extremely difficult to remove therefrom. Accordingly, there is provided an apparatus for metering a supply of release material to the surface of cylinder 64. Preferably, the release material is a low molecular weight substance which is substantially solid at room temperature and has a relatively low viscosity at the operating temperature thereof. An example of such a material is polyethylene manufactured by Allied Chemical Company and having a designation AC-8 homopolymer.

With continued reference to FIG. 2, polyethylene 68 is disposed in the chamber of housing 70. Preferably, housing 70 includes an inner shell 72 which is made from a suitable metallic or molded plastic material. An outer liner 74 is mounted exteriorly of inner shell 72 and is substantially contiguous therewith. Preferably, liner 74 is made from a thermally resistive material which acts as an insulating agent to prevent the conduction of heat from the release agent to the exterior environment. By way of example, liner 74 may be made from a silicon material having a durometer of about 50 on the Shore A hardness scale. Heater 76 contacts inner shell 72 and is employed to raise the temperature of the release material. As shown, heater 76 is interposed between inner shell 72 and outer liner 74. In this way, the release material is maintained substantially in the fluid condition. For example, heater 76 generates sufficient heat to maintain the release material at a temperature of about 270° F. Preferably, heater 76 is a tubular configured resistance type heater wherein the resistors contained therein are made from a suitable nickel chromium alloy. In a closed loop system, heater 76 is controlled by a thermostat monitoring the temperature of the release material. Alternatively, heating elements may be molded in outer liner 74 to heat the release material.

Blade 78 having one marginal region thereof secured to housing 70 and the other marginal edge thereof closely adjacent to cylinder 64 adjusts the thickness of the layer of release material applied thereto. The detailed structure of blade 78 is described more fully in copending application Ser. No. 540,732, the disclosure of which is hereby incorporated into the present application.

In recapitulation, it is apparent that pursuant to the features of the present invention, as heretofore described, the release material is maintained in a substantially fluid condition by being positioned in a chamber having a thermally insulating liner which minimizes the loss of heat therefrom. A heater adjacent to the chamber furnishes sufficient heat to maintain the release material in a fluid state. The foregoing minimizes the concentration of oxides in the release material and insures that the release material is in a ready state at all times. In this way, the life of the release material is substantially extended.

It is, therefore, evident that there has been provided, in accordance with the present invention, an apparatus for metering a supply of fluid release material to a fuser roller employed in the fusing apparatus of an electrophotographic printing machine. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for metering a quantity of release material to a fuser member operatively associated with a back-up member to substantially fix particles to a sheet of support material passing therebetween, including:

a housing defining a chamber for storing therein the release material, said housing comprising an inner shell defining the chamber for storing therein the release material, and an outer liner mounted contiguous with said inner shell and being made preferably from a thermally insulating material to substantially reduce loss of heat from the release material to the environment;

a substantially tubular heating member positioned in contact with a portion of said inner shell for heating said housing to maintain the release material in a substantially fluid state; and means for applying release material from said housing to the surface of the fuser member.

2. An apparatus as recited in claim 1, wherein said applying means includes a blade member having one marginal edge portion thereof secured to said housing with the other marginal edge portion thereof being closely adjacent to the fuser member to regulate the thickness of the layer of release material applied thereto.

3. A fusing apparatus employed in an electrostatographic printing machine for substantially permanently affixing toner particles to a sheet of support material, including:

a heated fuser roll;

a backup roll operatively associated with said fuser roll to enable the sheet of support material to pass therebetween with the toner particles contacting said fuser roll;

a housing defining a chamber for storing therein the release material, said housing comprising an inner shell defining the chamber for storing therein the release material and an outer liner mounted contiguous with said inner shell and being made preferably from a thermally insulating material to substantially reduce loss of heat from the release material to the environment;

a substantially tubular heating member positioned in contact with a portion of said inner shell for heating said housing to maintain the release material in a substantially fluid state; and means for applying release material from said housing to the surface of said fuser roll.

4. A fusing apparatus as recited in claim 3, wherein said applying means includes a blade member having one marginal edge portion thereof secured to said housing with the other marginal edge portion thereof being closely adjacent to said fuser roll to regulate the thickness of the layer of release material applied thereto.

* * * * *